United States Patent [19]

McGeeney

[11] 3,988,916

[45] Nov. 2, 1976

[54] APPARATUS FOR COILING STRIPLIKE MATERIAL

[75] Inventor: William Stone McGeeney, Pittsburgh, Pa.

[73] Assignee: Wean United, Inc., Pittsburgh, Pa.

[22] Filed: Mar. 17, 1975

[21] Appl. No.: 559,279

[52] U.S. Cl. ..... 72/148

[51] Int. Cl.[2] ..... B21C 47/06

[58] Field of Search ..... 242/78, 78.3, 55, DIG. 3, 242/81, 55.1; 72/148, 147, 146, 164, 165, 172, 166

[56] References Cited

UNITED STATES PATENTS

| | | | |
|---|---|---|---|
| 2,125,660 | 8/1938 | Whalen | 72/148 X |
| 2,792,996 | 5/1957 | Lorig | 72/148 |
| 3,328,990 | 7/1967 | Sieger | 72/148 |
| 3,841,131 | 10/1974 | Gross et al. | 72/148 |

*Primary Examiner*—George F. Mautz
*Attorney, Agent, or Firm*—Daniel Patch

[57] ABSTRACT

The disclosure of this invention pertains to a strip guiding mechanism for use with a rotating mandrel around which strip is wound into a coil. The guiding mechanism consists of two carriages movable in opposite radial directions towards and away from the mandrel. The carriages are mounted on a common frame that is movable in an axial direction of the mandrel to a position in front thereof after the coil has been started and then the frame is rotated to remove the carriage from the front of the mandrel to allow on completion the removal of the coil from the mandrel.

5 Claims, 9 Drawing Figures

APPARATUS FOR COILING STRIPLIKE MATERIAL

While the present invention may be employed for coiling strip formed of many different materials, such as, rolled steel strip, rubber, plastic, paper, etc., for the purpose of the description, its application to rolled steel strip has been chosen.

In the steel industry for many operations in forming coils of rolled strip, the strip is wound on a rotating mandrel or reel with the assistance of a belt wrapper. The wrapper consists of one or more continuous belts that are caused to encircle a substantial portion of the mandrel preparatory to the leading end of the rapidly moving strip being fed to the mandrel. The belts, when in contact with the mandrel, are driven by friction generated by the mandrel and thus urge the strip around the mandrel's periphery. Once several initial wraps are wound, the belt wrapper is retracted away from the mandrel and the mandrel is left to complete the coiling operation by itself.

In such belt wrapper devices the length of the belts becomes extremely long and requires very complicated mechanisms for supporting and guiding and for keeping the belts taut. Moreover, the life of the belts is very short, requiring repeated maintenance.

It is, therefore, the object of the present invention to provide an improved device for coiling strip on a rotating mandrel, the device being preferably of a "beltless type" but yet assuring that a proper coiling will be accomplished and one that will be inexpensive to manufacture, operate and maintain and wherein in only a few special cases will the use of belts be required and, even in such cases the belt construction is very simple and troublefree.

It is still another object of the present invention to provide apparatus for guiding strip around a rotatable mandrel comprising a support means arranged to one side of and parallel to the axis of rotation of said mandrel, a frame carried by said support means and arranged to extend towards said mandrel, strip guiding means carried by said frame arranged closely adjacent to two separate portions of said mandrel on opposite sides thereof for guiding strip therearound, means for moving said guiding means towards and away from said mandrel, means for moving said frame and guiding means as a unit in a first direction relative to said mandrel to allow said frame to be moved in a second and different direction relative to said mandrel, and means for moving said frame in a said second direction.

Figure 1:
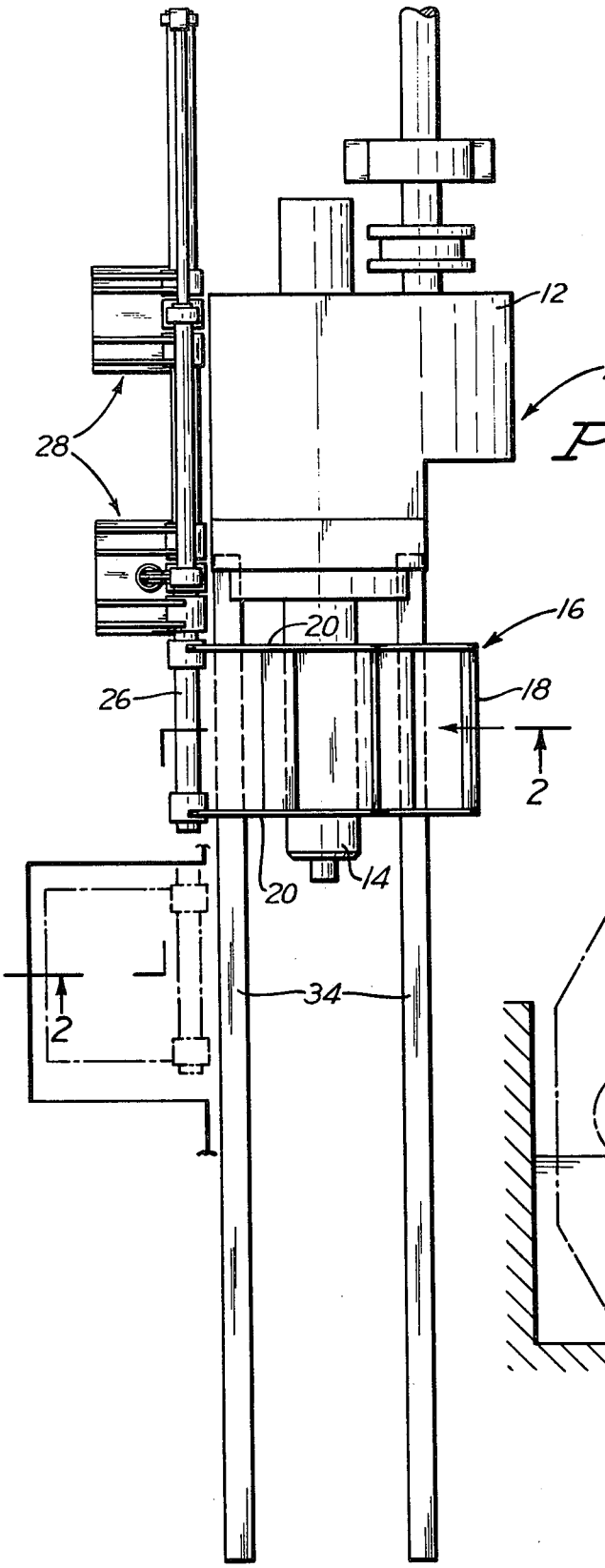
Figure 2:
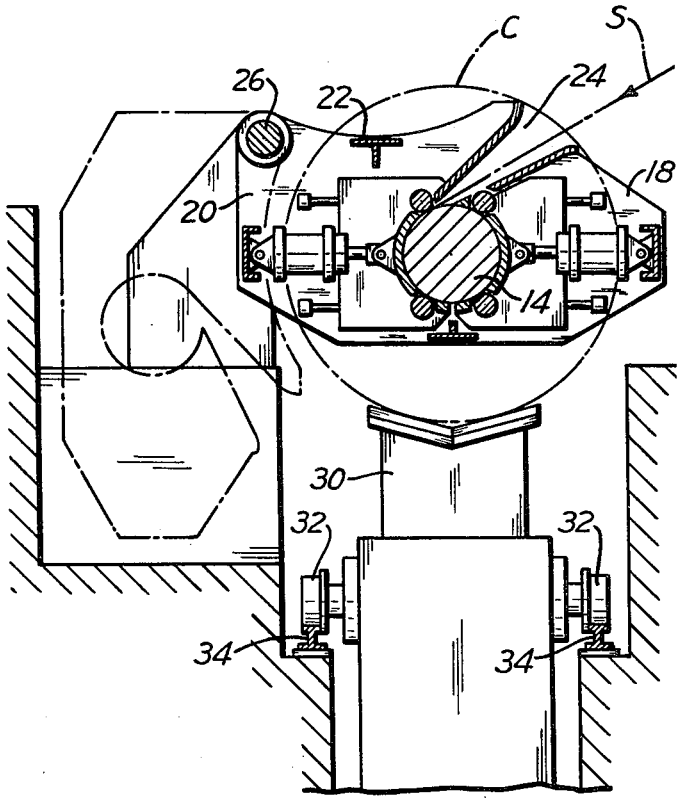
Figure 3:
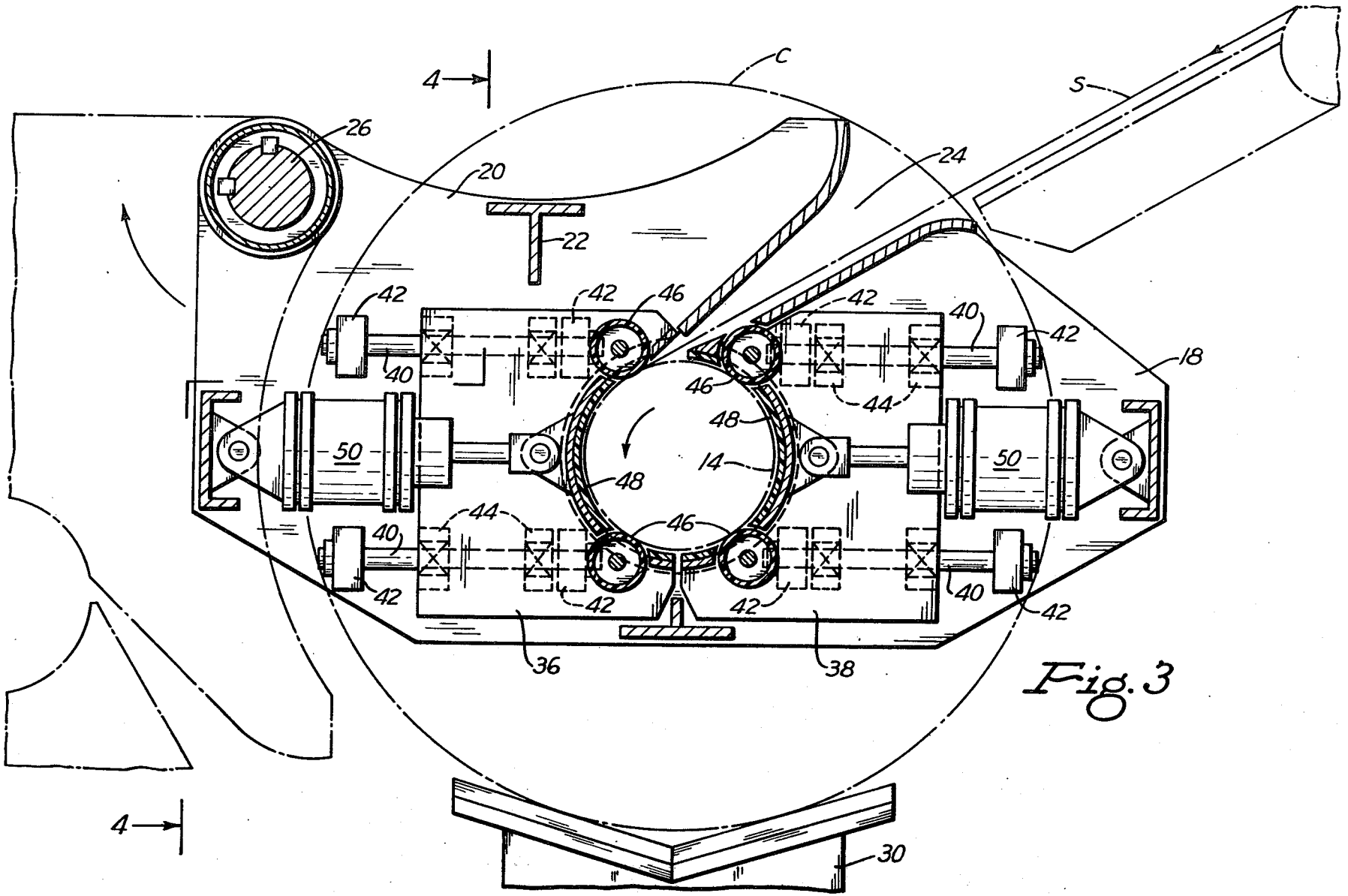
Figure 4:
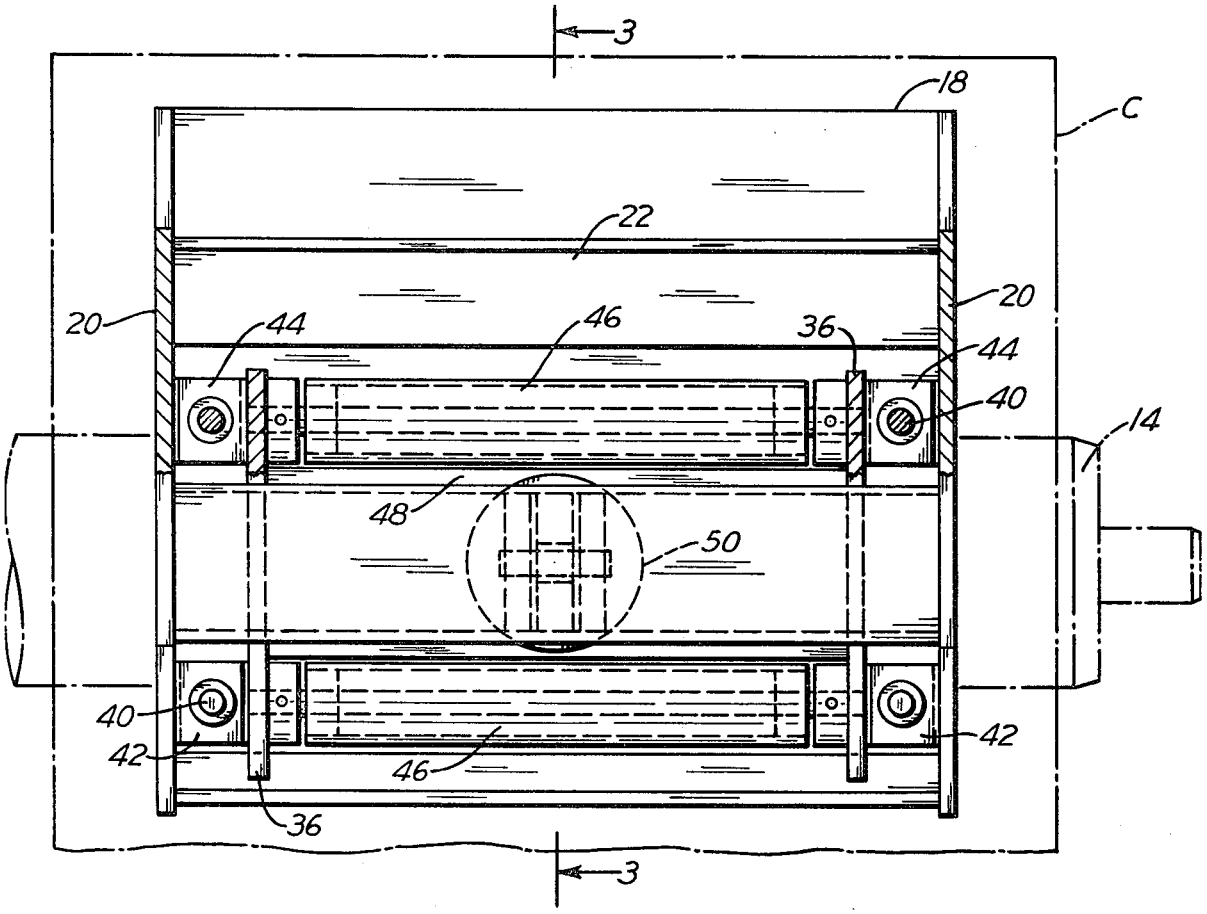
Figure 9:
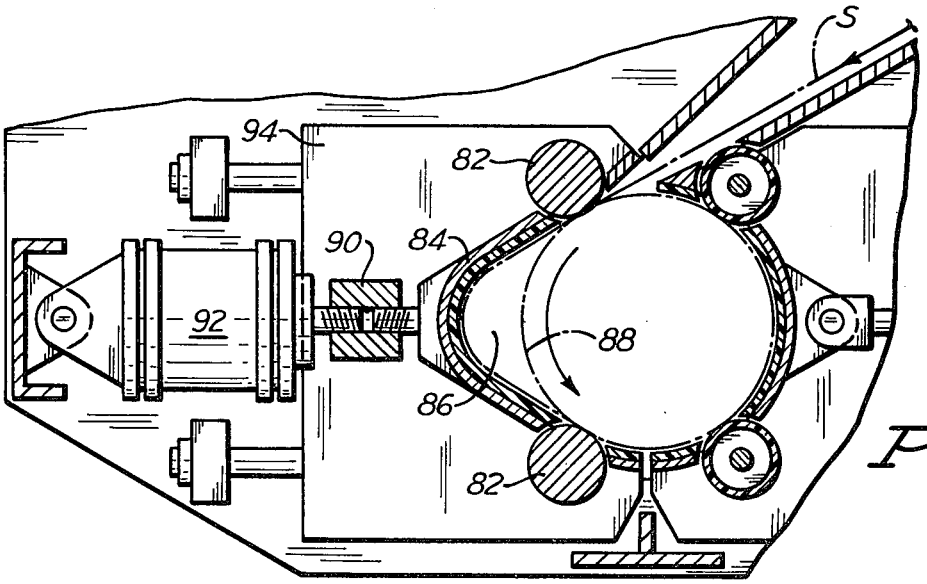
Figure 5:
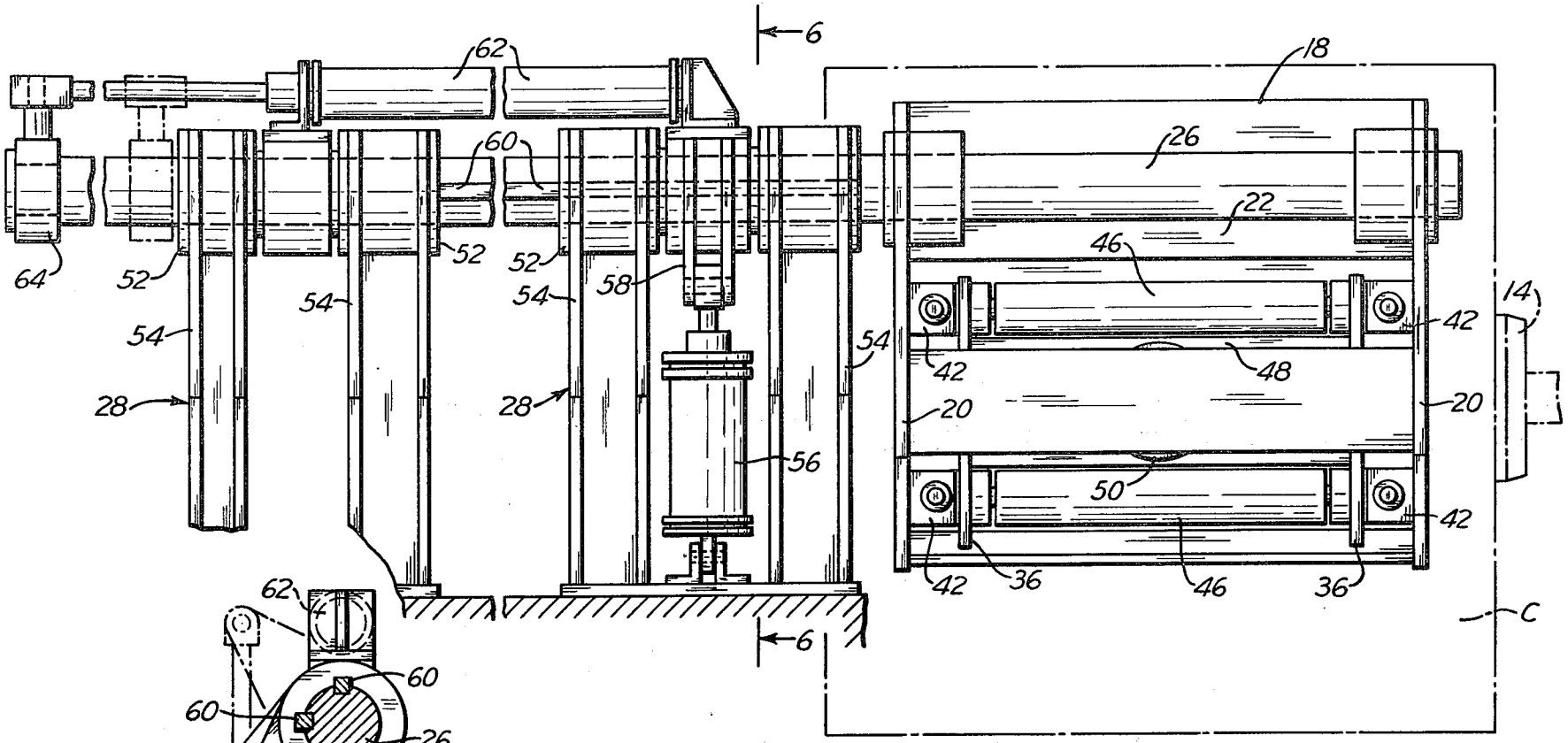
Figure 6:
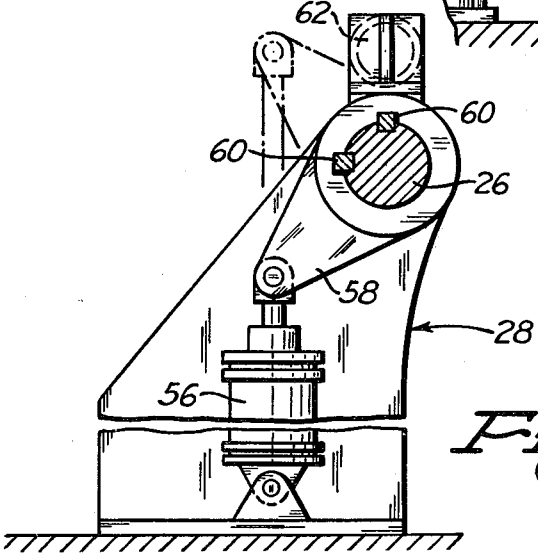
Figure 7:
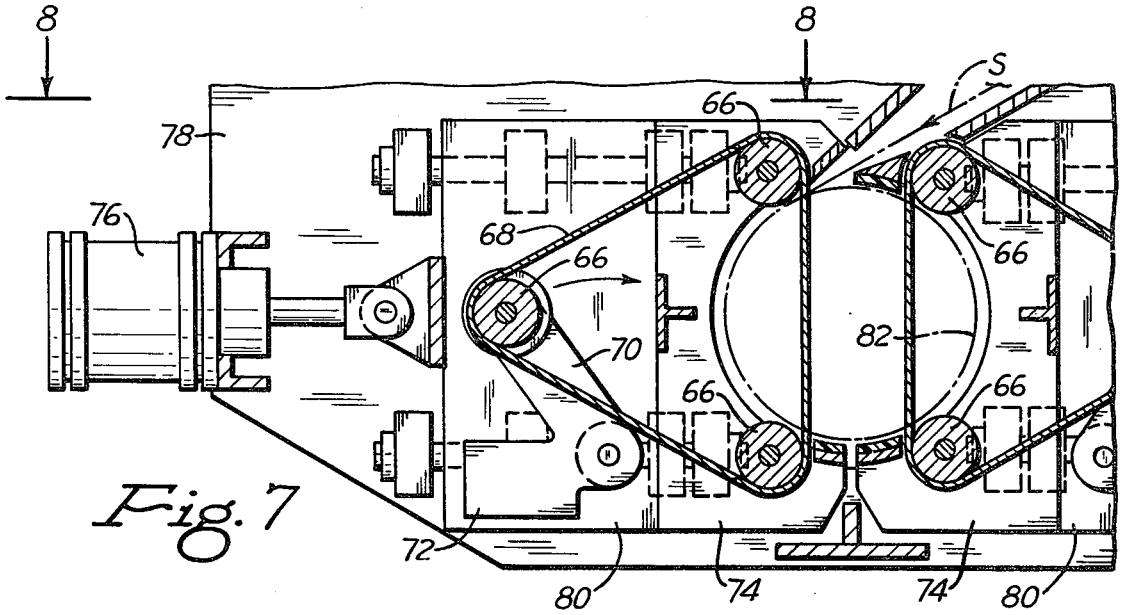
Figure 8:
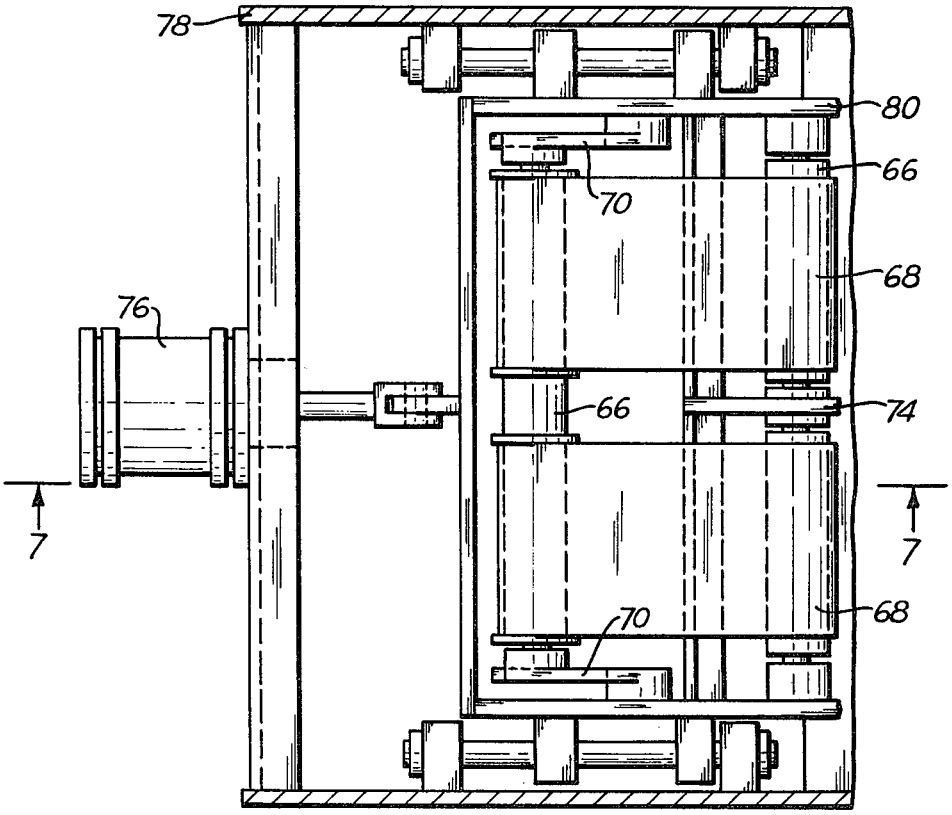

These objects as well as other novel features and advantages of the present invention will be better understood when the following description is read along with the accompanying drawings of which:

FIG. 1 is a plan view of a strip guiding device shown in combination with a mandrel, in which the strip guiding device is built in accordance with the features of the present invention, FIG. 2 is a sectional view taken on lines 2 — 2 of FIG. 1, FIG. 3 is a sectional view taken on lines 3 — 3 of FIG. 4, FIG. 4, is a sectional view taken on lines 4 — 4 of FIG. 3, FIG. 5 is an enlarged plan view of a portion of FIG. 1, FIG. 6 is a sectional view taken on lines 6 — 6 of FIG. 5, FIG. 7 is a sectional view taken on lines 7 — 7 of FIG. 8 and illustrating a second embodiment of the present invention, FIG. 8 is a sectional view taken on lines 8 — 8 of FIG. 7, and FIG. 9 is a partial sectional view of a third embodiment of the present invention.

In referring first to FIG. 1, there is illustrated a mandrel assembly 10 for coiling cold rolled mild carbon steel strip, the design of which follows well-known practice and which consists essentially of a drive 12 that rotates an outwardly extending collapsible mandrel 14 in a counterclockwise direction as indicated by the arrow in FIG. 3. The strips shown in FIGS. 2 and 3 are fed to the mandrel from the right as one views FIG. 1 and its leading end is guided around the mandrel by a strip guiding device 16 built in accordance with the present invention, its general outline form being better shown in FIG. 2.

The strip guiding device 16 is made up of a frame 18 consisting of two side members 20 tied together by several cross supports, such as, the T member 22, shown in FIG. 2. The frame provides an entrance slot 24 for the strip S. The frame is pivotally carried at its left on a rotating shaft 26 to which it is keyed, as shown in FIG. 6. FIG. 2 shows in phantom the frame 18 rotated away from the mandrel 14. The shaft, in turn, is supported by spaced pedestal assemblies 28, the support being such that the shaft is free to both move longitudinally and rotate, its extreme outward longitudinal position being shown in phantom in FIG. 1. Before leaving FIGS. 1 and 2, it will be noted that below and to the front of the mandrel 14 a coil car 30 is provided having wheels 32 that run on rails 34, FIG. 2 illustrating the car in a supporting relationship with a completed coil C in readiness to move the coil to a position at the end of the rails 34, in which it is to be understood that the strip guiding device 16 has been removed to its inoperative position, shown in phantom in FIG. 1.

The components carried by the frame 18 are best shown in FIGS. 3 and 4. On horizontal opposed sides of the mandrel 14 are arranged carriages 36 and 38, each mounted on two pairs of horizontal guide rods 40; the rods being supported by the side members 20 of the frame by brackets 42. The carriages, in turn, have bearing blocks 44 through which the rods pass. The sides of the carriages 36 and 38 adjacent the mandrel 14 have a pair of freely rotatable guide rollers 46 separated by crescent-shaped guide aprons 48. At the bottom and top additional small guide aprons are provided to form a substantially continuous circular strip guiding surface around the outer periphery of the mandrel 14.

The upper roller 46 of the carriage 36 is positioned to contact the strip immediately after it leaves the lower end of the chute 24 of the frame 18, it being noted that the rollers are initially driven by their contact with the mandrel and after the first wrap of the coil is formed, then by their contact with the strip. FIG. 4 illustrates that the rollers are formed of tubular outer casings which are mounted on non-rotating rods 48. The carriages 36 and 38 are moved towards and away from the mandrel 14 to position the rollers 46 and the aprons 48 into operative and inoperative positions by separate air piston cylinder assemblies 50 pivotally mounted to the frame 18 and the carriages.

FIGS. 5 and 6, along with FIG. 1, best illustrate the construction that imparts the two different movements of the frame 18. As noted before, the frame is moved rotatably from the hard line to the phantom line positions of FIGS. 1 and 2. This rotational movement, as well as the longitudinal movement, is accomplished by providing bearing blocks 52 in the pedestal assemblies 28, the assemblies 28, as shown in FIG. 5, actually comprising two pairs of uprights 54. Rotation of the shaft 26 is achieved through the agency of a piston cylinder assembly 56 connected to an arm 58 which is keyed to the shaft as best shown in FIG. 6. The two keys 60 are sufficiently long to allow for longitudinal movement of the shaft 26 relative to the arm 58. This latter movement is accomplished by a piston cylinder assembly 62 mounted on the pedestal assemblies 28 and connected to the outboard end of the shaft 26 by a connecting ring 64, a hard-line broken position and a phantom position in FIG. 5, serving to indicate the two extreme positions of the piston rod, ring and shaft.

The second embodiment of the invention illustrated in FIGS. 7 and 8 is designed to accommodate strip where surface blemishes, such as, scratches, are troublesome problems. The strip guiding device of this assembly is very similar in construction to the first embodiment, except that instead of the guide rollers a belt assembly has been provided for each carriage. In view of this similarity, it is only necessary to describe one of the belt assemblies. This consists of three belt supporting rollers 66 on which are trained two endless belts 68. The innermost roller 66 is mounted on a pivotally supported pair of arms 70 which are constantly urged in a direction to keep the belts under a desired tension by a spring assembly 72. As shown in FIG. 8, the front rollers 66 are supported by a central bracket 74. A piston cylinder assembly 76 mounted on the frame 78 moves the carriage 80 towards and away from the mandrel 82.

The further embodiment, shown in FIG. 9, is a further modification of the strip guiding device illustrated in FIGS. 1 – 6. Instead of the first two rollers being friction driven by the mandrel in FIG. 9, the rollers are positively driven by air motors, now shown. In addition, the design of the apron 84 between the first two rollers is modified from a circular form to an hyperbolic form in which a substantial space 86 is provided between the guiding surface of the apron on the horizontal and the opposed surface of the mandrel 88. In order that the space between the driven rollers 82 and 84 and the mandrel 88 can be adjusted for varying operating conditions, a micrometer adjustable nut assembly 90 is provided as a connecting means between an hydraulic piston cylinder assembly 92 and the carriage 94. The strip guiding device of FIG. 9 is particularly advantageous in coiling thick and/or stiff strip in which the driving influence of the first roller 82 and the "lever effect" of providing the space 86 and the guiding action of the hyperbolic curve of the apron 84 will cause the leading end of the strip to be forcibly urged around the mandrel 88. If necessary, the rollers of the second carriage can also be driven.

In accordance with the provisions of the patent statutes, I have explained the principle and operation of my invention and have illustrated and described what I consider to represent the best embodiment thereof.

I claim:

1. In an apparatus for guiding strip around a rotatable mandrel comprising:

a support means arranged to one side of and parallel to the axis of rotation of said mandrel, a frame carried by said support means and arranged to extend towards said mandrel, said support means including a first means for allowing a translational movement of said frame, and a second means for allowing a rotational movement of said frame, strip guiding means carried by said frame arranged closely adjacent to two separate portions of said mandrel on opposite sides thereof for guiding strip therearound, means for moving said guiding means towards and away from said mandrel, power means operatively connected to said first means for imparting said translational movement of said frame and said guiding means as a unit relative to said mandrel, and power means operatively connected to said second means for imparting said rotational movement of said frame and said guiding means as a unit relative to said mandrel.

2. In an apparatus for guiding strip around a rotatable mandrel comprising:

a support means arranged to one side of and parallel to the axis of rotation of said mandrel, a frame carried by said support means and arranged to extend towards said mandrel, two carriages carried by said frame arranged closely adjacent to two separate portions of said mandrel on opposite sides thereof for guiding strip therearound, means for moving said carriages towards and away from said mandrel, each carriage having spaced-apart belt rollers and continuous belts trained to pass over said rollers in parallel paths of travel, said carriages and belts being so constructed and arranged that said belts are caused to engage said mandrel when in said towards position, means for moving said frame and carriages as a unit in a first direction relative to said mandrel to allow said frame and carriages to be moved in a second and different direction relative to said mandrel, and means for moving said frame and carriages in a said second direction.

3. In an apparatus for guiding strip around a rotatable mandrel comprising:

a support means arranged to one side of and parallel to the axis of rotation of said mandrel, a frame carried by said support means and arranged to extend towards said mandrel, means for permitting said frame to pivot about an axis of said support means, two separate guiding units carried by said frame arranged closely adjacent to two separate portions of said mandrel on opposite sides thereof, and each comprising strip guiding elements arranged to guide strip around said mandrel, separate power means for moving said guiding units towards and away from said mandrel, means for moving said frame and said guiding units as a unit in a first direction relative to said mandrel to allow said frame and guiding units to be moved in a second and different direction relative to said mandrel, and means for moving said frame and guiding units in a said second direction.

4. In an apparatus according to claim 3, wherein said support means includes a shaft, means for securing said frame to said shaft for rotation therewith, and means for supporting said shaft so as to permit a translational movement in said first direction and a rotational movement in said second direction so that a coil of strip can be formed on said mandrel and removed therefrom without interference by said strip guiding elements.

5. In an apparatus according to claim 3, wherein, one of said strip guiding elements includes two spaced-apart strip urging rollers, one strip guiding element being arranged to first receive the leading end of said strip from one of said rollers and formed with a contour so as to allow the strip to be displaced away from the surface of the mandrel prior to being urged by said other roller around a following portion of said mandrel.

* * * * *